United States Patent [19]

Kudlacek

[11] Patent Number: 4,761,888

[45] Date of Patent: Aug. 9, 1988

[54] ARCHERY BOWSIGHT MOUNT AND METHOD OF ADJUSTMENT

[76] Inventor: Donald S. Kudlacek, 3412 Oak St., Longview, Wash. 98632

[21] Appl. No.: 37,659

[22] Filed: Apr. 13, 1987

[51] Int. Cl.[4] ..... F41G 1/46

[52] U.S. Cl. ..... 33/265; 33/257

[58] Field of Search ..... 33/228, 265, 257; 124/87

[56] References Cited

U.S. PATENT DOCUMENTS

| | | | |
|---|---|---|---|
| 3,355,809 | 12/1957 | Guyton | 33/265 |
| 3,854,217 | 12/1974 | Killian | 33/265 |
| 3,864,836 | 2/1975 | Haines | 33/265 |
| 4,142,298 | 3/1979 | Killian | 33/265 |
| 4,368,581 | 1/1983 | Tullos | 33/265 |
| 4,567,668 | 2/1986 | King et al. | 33/265 |
| 4,625,421 | 12/1986 | Strauss | 33/265 |

*Primary Examiner*—William D. Martin, Jr.
*Attorney, Agent, or Firm*—Olson & Olson

[57] ABSTRACT

The archery bowsight of this invention includes windage and elevation carriages which are adjustable by rack and gear connections, and also includes a bubble level the axis of which is adjustable relative to said carriages to position it perpendicular to the longitudinal axis of an arrow supported on the arrow rest of the archery bow.

6 Claims, 1 Drawing Sheet

ARCHERY BOWSIGHT MOUNT AND METHOD OF ADJUSTMENT

BACKGROUND OF THE INVENTION

This invention relates to archery bowsights, and more particularly to a bowsight having a bubble level capable of being adjusted both to horizontal and perpendicular to the longitudinal axis of an arrow supported on the arrow rest of the bow.

Archery bowsights of the type having a bubble level heretofore have been capable only of adjustment of the bubble level to horizontal when the bow is disposed in the vertical plane required for shooting. However, since an arrow supported on a laterally adjustable arrow rest is thus disposed on a line that is not related to the disposition of the bubble level, the direction of arrow flight changes as the bow is swung vertically through the arc determined by the archer's arm that supports the bow.

SUMMARY OF THE INVENTION

The bowsight of this invention provides for adjustment of the axis of the bubble level component not only to horizontal when the bow is disposed in the vertical plane required for shooting, but also to a position perpendicular to the longitudinal axis of an arrow supported on the arrow rest of the bow.

The principle objective of this invention is to provide a bowsight of the class described above by which to overcome the aforementioned limitation and disadvantage of prior bowsights which incorporate bubble levels.

Another objective of this invention is to provide a bowsight of the class described which accommodates precise adjustment of the axis of the bubble level component to a position perpendicular to the selected line of an arrow supported on the arrow rest of the bow.

A further objective of this invention is to provide a bowsight of the class described which is of simplified construction for economical manufacture and accommodates adjustment of the bubble level component with speed and precision.

The foregoing and other objects and advantages of this invention will appear from the following detailed description, taken in connection with the accompanying drawings of a preferred embodiment.

DESCRIPTION OF THE PREFERRED EMBODIMENT

Figures 1, 2, 3, 4, 5, 6:
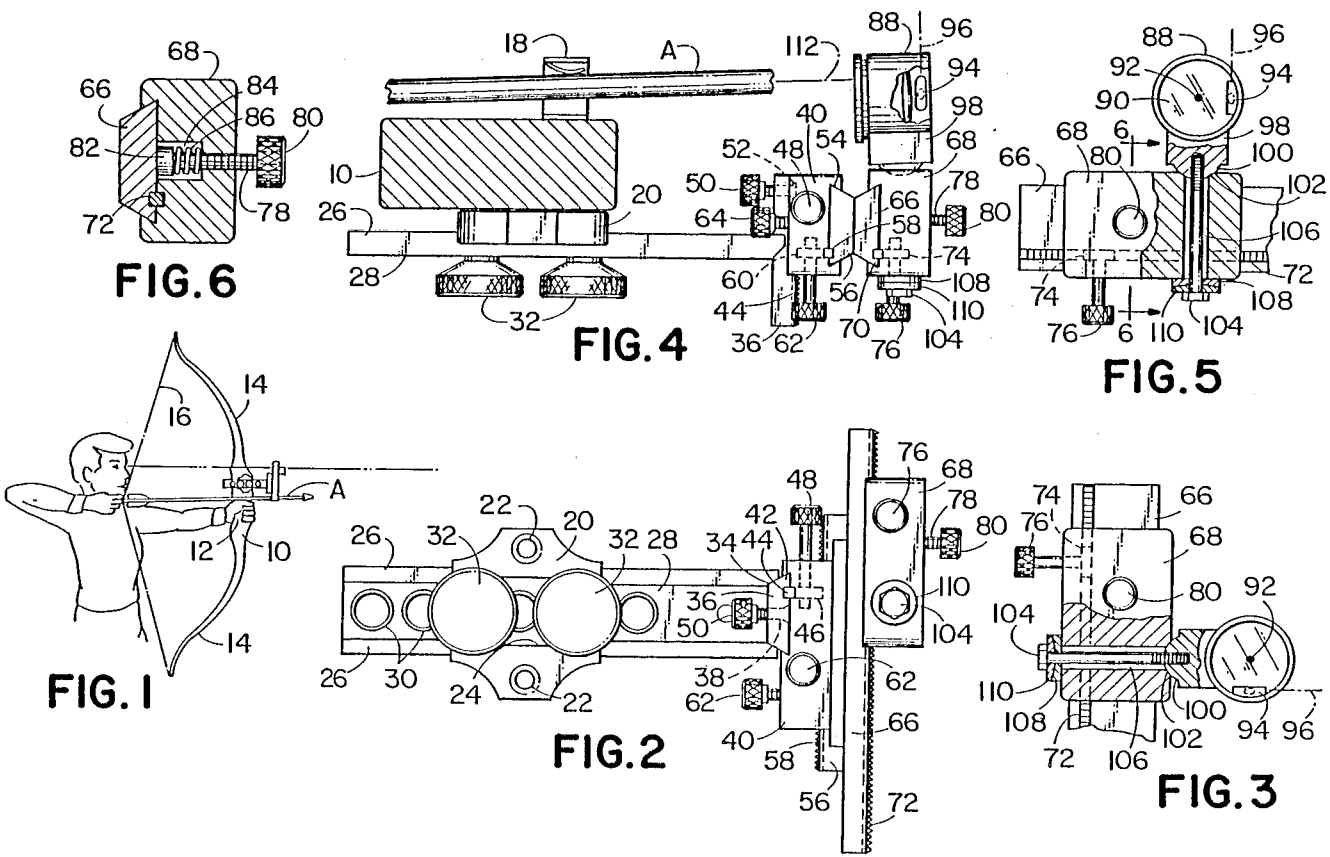
FIG. 1 is a side elevation illustrating the relationship of an archer with a bowsight on an archery bow at full draw.
FIG. 2 is a side elevation of an archery bowsight embodying the features of this invention.
FIG. 3 is a fragmentary front elevation as viewed from the right in FIG. 2.
FIG. 4 is a plan view as viewed from the top in FIG.
FIG. 5. is a fragmentary front elevation as viewed from the right in FIG. 4.
FIG. 6 is a sectional view, on an enlarged scale, taken on the line 6—6 in FIG. 5.

In FIG. 1 of the drawings there is shown for the purpose of illustration an archery bow handle 10 provided with a hand grip portion 12 and mounting a pair of opposite limbs 14 the outer ends of which support a bow string 16 by which to project an arrow A. The rearward, nock end of the arrow engages the string and a forward portion of the arrow is supported on an arrow rest 18 which, as illustrated graphically in FIG. 4, is usually adjustable laterally of the bow handle for the purpose of achieving maximum precision of aimlng accuracy for the particular bow and archer.

The archery bowsight of this invention includes a mounting plate 20 provided with openings 22 for the reception of screws by which the mounting plate is secured to the appropriate side of the bow handle. In this regard, it is to be noted from FIG. 1 that the bowsight is mounted on the right side of the bow handle for use by a right-handed archer.

The mounting plate is provided with a longitudinal dovetail groove 24 configured to receive the beveled edges 26 of an elongated support arm 28. The arm is provided with a plurality of longitudinally spaced openings 30 for the reception of anchor screws 32 which are receivable removably in registering threaded openings in the mounting plate. It is by this means that the support arm 28 may be adjusted longitudinally relative to the mounting plate.

A notch 34 in the front end of the support arm 28 removably seats a windage carriage guide 36 which extends horizontally and perpendicular to the support arm 28. The guide 36 is secured to the arm 28 by means of a screw 38 which extends through an opening in the guide and is threaded into a tapped opening in the front end of the support arm 28.

A windage carriage 40 is provided with a dovetail groove 42 by which to mount it slidably on the windage carriage guide 36. An elongated rack 44 on the carriage guide is engaged by a gear 46 on the windage carriage for rotation by a hand knob 48. Rotation of the gear moves the windage carriage along the carriage guide to any desired position of adjustment. The position of adjustment of the windage carriage is secured releasably by a lock screw 50 which extends through a threaded opening in the carriage guide 36 and is provided on its inner end with a friction pad 52 for releasable contact with the confronting surface of the windage carriage 40, without marring said surface.

The windage carriage 40 also is provided with a dovetail groove 54 on the side opposite and extending perpendicular to the dovetail guide groove 42. The dovetail groove 54 slidably receives the beveled edges of a vertically extending first elevation carriage guide 56. An elongated rack 58 on the carriage guide 56 is engaged by a gear 60 mounted rotatably in the windage carriage 40. A hand knob 62 facilitates rotation of the gear and consequent movement of the first elevation carriage guide 56 relative to the windage carriage.

A lock screw 64 extends through a threaded opening in the windage carriage 40 for releasable friction contact with the confronting surface of the first elevation carriage guide 56. The lock screw 64 is provided with a friction pad on its inner end, either in the manner of the friction pad 52 described hereinbefore, or in the manner of a spring-loaded friction pad described in detail hereinafter.

A second elevation carriage guide 66 is secured to the first elevation guide 56, as by means of screws (not shown), for simultaneous movement therewith. An elevation carriage 68 is provided with a dovetail groove 70 for slidable reception of the beveled edges of the second elevation carriage guide 66. A rack 72 on the second elevation carriage guide is engaged by a gear 74 on the elevation carriage. A hand knob 76 is associated with the gear to facilitate rotation of the latter for moving the elevation carriage along the vertically extending second elevation carriage guide 66.

The elevation carriage 68 is secured releasably in any desired position of adjustment along the second elevation carriage guide 66 by means of the lock screw 78 provided with a hand knob 80. In the preferred embodiment illustrated, and best shown in FIG. 6, the lock screw 78 extends inwardly through a tapped opening in the elevation carriage and its inner end freely abuts the confronting end of a friction pad 82 mounted for movement in an enlarged pocket 84 in the rearward side of the elevation carriage. A coil spring 86 encircles the inner end of the lock screw 78 within the pocket 84. One end of the spring abuts the bottom end of the pocket and the opposite end of the spring abuts the inner end of the friction pad 82. The friction pad thus is urged resiliently into frictional engagement with the confronting surface of the second elevation carriage guide 66.

The spring-loaded friction pad 82 thus is maintained at all times in frictional contact with second elevation carriage guide 66, to prevent inadvertent movement of the carriage 68 even when the lock screw 78 is retracted. This allows deliberate readjustment of the carriage against the slight resistance of the friction pad, after which the carriage is secured positively in adjusted position by tightening the lock screw so that its inner end abuts the friction pad and moves it into positive locking position against the second elevation carriage guide 66.

The elevation carriage serves to mount a bowsight, and particularly a bowsight of the type that includes a bubble level which assists in positioning the bow string 16 in a vertical plane preparatory to shooting. In the embodiment illustrated, the bowsight includes a hollow sight case 88 in which is mounted a sight lens 90 provided with a central sight dot 92. The sight case mounts a bubble level 94 having a longitudinal axis 96 on which the bubble is leveled when the axis 96 is in a horizontal plane.

The sight case 88 is secured to a post 98 provided at its outer end with a convexly arcuate base 100. A correspondingly concavely arcuate socket 102 is provided in the confronting surface of the elevation carriage 68, for seating the arcuate base 100 in any desired position of relative rotation. An elongated lock screw 104 is secured at its inner end in the post 98 and extends through an enlarged bore 106 in the elevation carriage. The size of the bore 106 relative to the diameter of the lock screw 106 allows sufficient adjustment of the post 98 on the axis of the screw 104, to effectuate adjustment of the axis 96 of the bubble level described hereinafter. The lock screw 104 extends freely through a concave washer 108 the flat surface of which abuts the confronting surface of the elevation carriage 68. The concave surface of washer 108 is engaged by the convex surface of a convex washer 110. The flat surface of the convex washer is abutted by the head of the screw 104.

It will be apparent that the washers 108 and 110 function to allow movement of the lock screw 104 laterally in the enlarged bore 106, for adjusting the bubble level axis 96, and thereafter to secure the adjustment by tightening the lock screw without disturbing the adjustment of the bubble level axis.

It is an important feature of this invention that the mounting of the bowsight enables adjustment of the axis 96 of the bubble level 94 not only to the horizontal plane for positioning the bow string in a vertical plane, but also to position the bubble level axis 96 perpendicular to the longitudinal axis 112 of an arrow A supported on the arrow rest 18. This is the position of adjustment illustrated in FIG. 4 of the drawings, and it is this position of adjustment that insures that the arrow will be directed precisely at a selected target throughout the entire range of arcuate movement of the bow in the vertical plane, on the radius of the archer's extended arm.

The adjustment of the axis 96 of the bubble level 94 to a position precisely perpendicular to the longitudinal axis 112 of the arrow A, preferably is achieved in the following manner: A sufficient number of test shootings to a given target is made while adjusting the arrow rest laterally to achieve the best groupings of arrows at the target, all the while utilizing the sight 92.

With the arrow rest thus adjusted to optimum position established empirically by achieving the best arrow groupings, the lock screw 104 is loosened slightly to allow the arcuate base 100 of the sight post 98 to be rotated on the arcuate socket 102 until the bubble level axis 96 is adjusted to the position precisely perpendicular to the longitudinal axis 112 of an arrow supported on the arrow rest 18. This adjustment may be facilitated by the use of a carpenter's square, by placing one edge of the square against the front surface of the sight case 88 with the perpendicular leg of the square extending rearward therefrom approximately parallel to the longitudinal axis 112 of the arrow. The sight case is adjusted until the rearwardly extending leg of the square extends precisely parallel to the longitudinal axis of the arrow on the arrow rest. The lock screw 104 then is tightened to secure the adjusted position of the bubble level.

It will be apparent to those skilled in the art that various changes may be made in the size, shape, type, number and arrangement of parts described hereinbefore without departing from the spirit of this invention and the scope of the appended claims.

Having now described my invention and the manner in which it may be used, I claim:

1. An archery bowsight comprising:

(a) a bowsight support arranged to be mounted on the handle of a bow, (b) a sight member mounting a bubble level, and (c) mounting means mounting the sight member on the support for adjustment of the axis of the bubble level to horizontal and also perpendicular to the longitudinal axis of an arrow supported on the arrow rest of the bow, the mounting means including (1) ball and socket means interconnecting the support and sight member for moving the bubble level pivotally for adjusting the axis thereof to horizontal and also perpendicular to the longitudinal axis of an arrow supported on the arrow rest of the bow, (2) an elevation carriage member, the ball and socket means interconnecting the elevation carriage member and sight member, (3) an elongated elevation carriage guide member having an elongated rack thereon, a rotary gear on the elevation carriage member engaging the rack for moving the carriage member along the guide member, and (4) lock means on the carriage member releasably engaging the guide member for securing the carriage member in adjusted position on the guide member, the lock member comprising an elongated threaded lock screw mounted on the carriage member for movement toward and away from the guide member, a friction pad member interposed between the lock screw and the guide member, and resilient means interposed between the pad member and the carriage member for urging the carriage member toward the guide member.

2. An archery bowsight, comprising:

(a) a bowsight support arranged to be mounted on the handle of a bow, (b) a sight member mounting a bubble level, and (c) mounting means mounting the sight member on the support for adjustment of the axis of the bubble level to horizontal and also perpendicular to the longitudinal axis of an arrow supported on the arrow rest of the bow, said mounting means including ball and socket means interconnecting the support and sight member for moving the bubble level pivotally for adjusting the axis thereof to horizontal and also perpendicular to the longidutinal axis of an arrow supported on the arrow rest of the bow.

3. The archery bowsight of claim 2 wherein the mounting means includes an elevation carriage member, and the ball and socket means interconnects the elevation carriage member and sight member.

4. The archery bowsight of claim 3 wherein the mounting means includes an elongated elevation carriage guide member having an elongated rack thereon, a rotary gear on the elevation carriage member engages the rack for moving the carriage member along the guide member, and lock means on the carriage member releasably engages the guide member for securing the carriage member in adjusted position on the guide member.

5. The archery bowsight of claim 4 wherein the lock means comprises an elongated threaded lock screw mounted on the carriage member for movement toward and away from the guide member, a friction pad member is interposed between the lock screw and the guide member, and resilient means is interposed between the pad member and the carriage member for urging the pad member toward the guide member.

6. In an archery bow having a laterally adjustable arrow rest and a bowsight having a sight member mounting a bubble level, the method of adjusting the sight member relative to the bow comprising the preliminary steps of adjusting the arrow rest laterally for optimum accuracy of arrow flight at a selected distance, and thereafter adjusting the axis of the bubble level to horizontal and also perpendicular to the longitudinal axis of an arrow supported on the arrow rest.

* * * * *